US011262130B1

(12) United States Patent
Chambers

(10) Patent No.: US 11,262,130 B1
(45) Date of Patent: Mar. 1, 2022

(54) SYSTEM AND METHOD FOR HEAT AND PRESSURE TREATMENT

(71) Applicant: Kolorfusion International, Inc., Denver, CO (US)

(72) Inventor: Bryan Chambers, Centennial, CO (US)

(73) Assignee: Kolorfusion International Inc., Denver, CO (US)

( * ) Notice: Subject to any disclaimer, the term of this patent is extended or adjusted under 35 U.S.C. 154(b) by 19 days.

(21) Appl. No.: 16/291,370

(22) Filed: Mar. 4, 2019

Related U.S. Application Data

(63) Continuation of application No. 15/842,448, filed on Dec. 14, 2017, now abandoned.

(51) Int. Cl.
*B65B 11/54* (2006.01)
*F27D 7/06* (2006.01)
*F27D 1/00* (2006.01)

(52) U.S. Cl.
CPC ..... *F27D 7/06* (2013.01); *F27D 1/0003* (2013.01); *F27D 2007/066* (2013.01)

(58) Field of Classification Search
CPC ..... B65D 75/002; B65D 71/08; B65B 53/02; B65B 21/245; B65B 53/00; B65B 11/00; B65B 11/54; B29C 66/7315
See application file for complete search history.

(56) References Cited

U.S. PATENT DOCUMENTS 4,164,111 A * 8/1979 Di Bernardo ..... B65B 31/024 53/434
4,457,122 A * 7/1984 Atkins ..... B65B 31/024 53/434
4,809,622 A * 3/1989 Schiferl ..... F27D 1/00 110/336
5,044,142 A * 9/1991 Gianelli ..... B65B 31/024 53/434
5,308,426 A 5/1994 Claveau
5,940,952 A * 8/1999 Ikeda ..... B29C 66/1122 29/423
5,962,368 A 10/1999 Poole
(Continued)

OTHER PUBLICATIONS

U.S. Appl. No. 90/005,714 Re-examination Certificate dated Jun. 20, 2002, 2 pages.
(Continued)

*Primary Examiner* — Gregory A Wilson
(74) *Attorney, Agent, or Firm* — Adsero IP

(57) ABSTRACT

Novel tools and techniques for heat and pressure treatment are provided. A system for heat and pressure treatment includes a vacuum pump, an enclosure, and an oven. The enclosure may include a body defining an inner volume, wherein the enclosure is configured to enclose at least part of a component within the inner volume, and sustain a vacuum pressure that is less than an ambient atmospheric pressure within the inner volume. The oven may be configured to receive and heat the enclosure. The vacuum pump may evacuate gases from within the inner volume and create the vacuum pressure. Under the vacuum pressure, the body may be configured to make surface contact with a surface of the at least part of the component, and to apply a mechanical pressure against the surface of the at least part of the component.

15 Claims, 4 Drawing Sheets

(56) References Cited

U.S. PATENT DOCUMENTS

| | | | | |
|---|---|---|---|---|
| 6,862,867 | B2 * | 3/2005 | Cady | B29C 65/18 53/434 |
| 9,327,857 | B2 * | 5/2016 | Scaliti | B65B 61/24 |
| 9,434,509 | B2 * | 9/2016 | Brautigam | A23C 9/137 |
| 2006/0027474 | A1 * | 2/2006 | Curtsinger | B27B 5/29 206/349 |
| 2010/0109321 | A1 * | 5/2010 | Sawamura | F16L 55/24 285/239 |
| 2010/0223889 | A1 * | 9/2010 | Napravnik | F27B 17/00 53/442 |
| 2011/0126960 | A1 * | 6/2011 | Orlandi | B65C 3/065 156/84 |
| 2014/0272747 | A1 * | 9/2014 | Ciurkot | B65B 65/06 432/239 |
| 2015/0059290 | A1 * | 3/2015 | Ewert | B65B 11/48 53/432 |
| 2016/0066483 | A1 * | 3/2016 | Fukuda | H01B 1/02 174/68.3 |
| 2016/0152390 | A1 * | 6/2016 | Itoh | B29C 55/28 426/127 |
| 2017/0144416 | A1 * | 5/2017 | Broadus | B32B 27/40 |

OTHER PUBLICATIONS

U.S. Appl. No. 15,842,448 NonFinalOA dated Dec. 13, 2018, 21 pages.

* cited by examiner

400

SYSTEM AND METHOD FOR HEAT AND PRESSURE TREATMENT

RELATED APPLICATIONS

This application is a continuation application of U.S. application Ser. No. 15/842,448 filed Dec. 14, 2017 by Bryan Chambers and titled, "System and Method for Heat and Pressure Treatment", which is incorporated herein by reference in its entirety.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to heat and pressure treatments of materials, and more particularly to tools and techniques for the heat and pressure treatment of irregularly shaped materials.

BACKGROUND

Heat and pressure have been used to treat various materials such as metals, glass, and various synthetic materials, such as polymers. Conventional heat treatment involves the use of heat to alter the physical and/or chemical properties of a material. Typical heat treatment techniques utilize high temperatures above 350 degrees Fahrenheit. The rates of heating and cooling are also controlled to produce a desired result, and may include the introduction of additional materials during the heat treatment process.

Some heat treatment techniques may also include treatment of materials under pressure. Pressure may be utilized to effect physical and chemical changes, as well as to aid in the penetration or extraction of substances to and from the treated materials. Typically, heat treatment with pressure processes requires costly, specialized equipment, such as autoclaves, pressure and vacuum ovens, and pressurized furnaces. Typically, these devices create a low or high-pressure environment pneumatically by changing the pressure of ambient gas around the material being treated.

Accordingly, novel tools and techniques for pressurized heat treatment of materials are provided.

BRIEF DESCRIPTION OF THE DRAWINGS

A further understanding of the nature and advantages of various embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

DETAILED DESCRIPTION OF CERTAIN EMBODIMENTS

Figure 1:
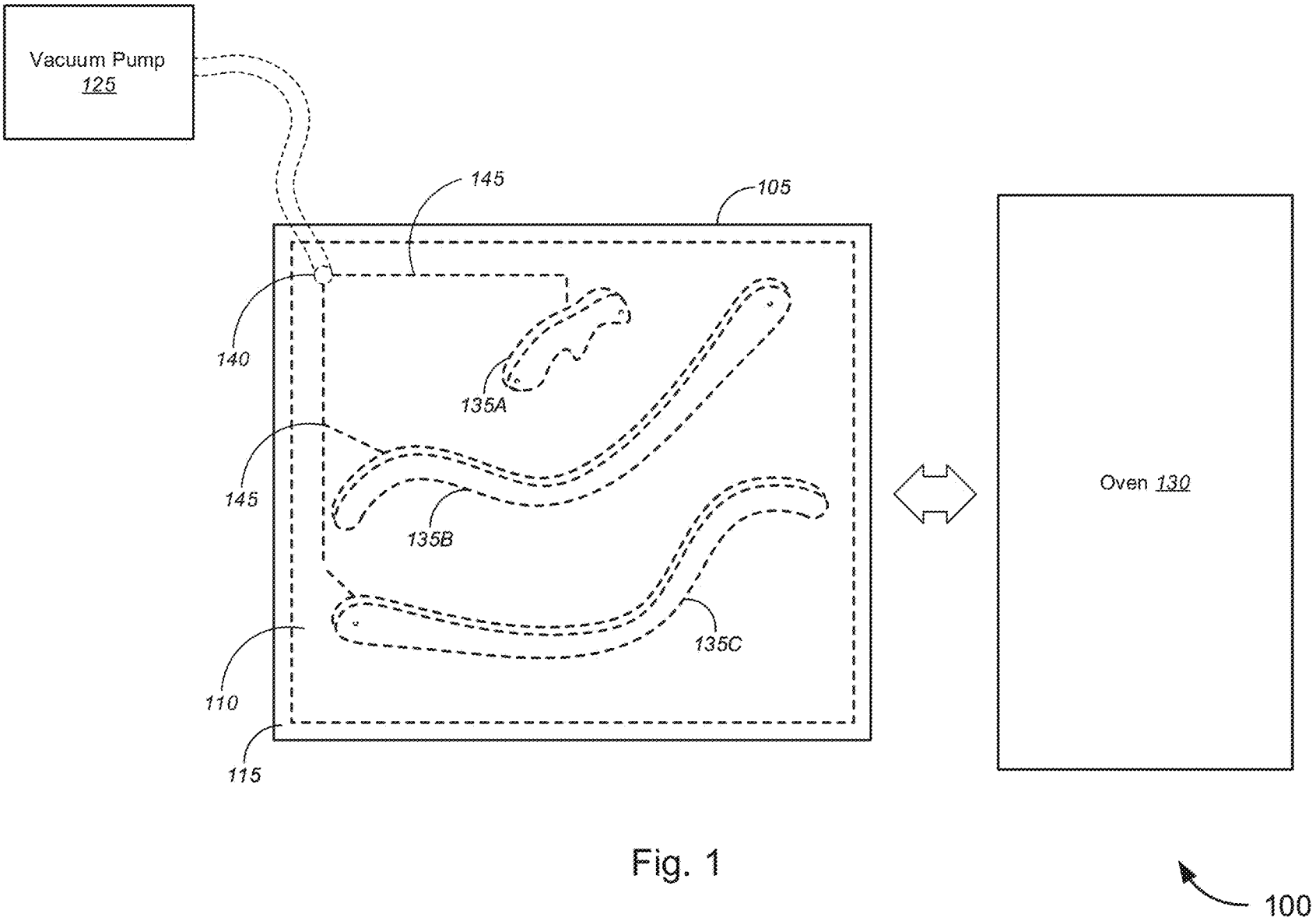
FIG. 1 is a schematic illustration of a system for heat and pressure treatment, in accordance with various embodiments.

The following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present may be practiced without some of these specific details. In other instances, certain structures and devices are shown in block diagram form. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth used should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

In an aspect, a system for heat and pressure treatment is provided. The system may include a vacuum pump, an enclosure, and an oven. The enclosure may include a body defining an inner volume, wherein the enclosure is configured to enclose at least part of a component within the inner volume. The enclosure may further be configured to pneumatically seal at least part of the component within the inner volume, and sustain a vacuum pressure that is less than an ambient atmospheric pressure around the at least part of the component within the inner volume. The oven may be configured to receive and heat the enclosure. The vacuum pump may be configured to be operatively coupled to the enclosure and evacuate gases within the inner volume, and create the vacuum pressure within the inner volume of the enclosure. Under the vacuum pressure, the body may be configured to make surface contact with a surface of the at least part of the component, and to apply a mechanical pressure against the surface of the at least part of the component.

In another aspect, an apparatus for heat and pressure treatment is provided. The apparatus may include an enclosure. The enclosure may include a body defining an inner volume, wherein the enclosure is configured to enclose at least part of a component within the inner volume. The enclosure may further be configured to pneumatically seal at least part of the component within the inner volume, and sustain a vacuum pressure that is less than an ambient atmospheric pressure around the at least part of the component within the inner volume. The enclosure may be configured to allow gases to be evacuated from within the inner volume. Under the vacuum pressure, the body may be configured to make surface contact with a surface of the at least part of the component, and to apply a mechanical pressure against the surface of the at least part of the component. The enclosure may further be configured to be heated, via an oven, to a desired temperature and substantially maintain structural properties at the desired temperature.

In a further aspect, a method for heat and pressure treatment is provided. The method may begin by receiving, via an enclosure, one or more components. The method may continue by sealing pneumatically, within an inner volume of the enclosure, the one or more components. The method continues by evacuating, via a vacuum pump, gases from within the inner volume of the enclosure, and creating, via the vacuum pump, a vacuum pressure within the inner volume of the enclosure. The method then continues by creating surface contact between a body of the enclosure and a surface of the one or more components, and applying, via the body of the enclosure, a mechanical pressure on the surface of the one or more components. The method may then continue by heating, via an oven, the enclosure to a desired temperature.

FIG. 1 is a schematic illustration of a system 100 for heat and pressure treatment. According to various embodiments, the system 100 includes an enclosure 105, vacuum pump 125, and oven 130. The enclosure 105 may include a body defining an inner volume 110. The inner volume 110 may, in some embodiments, contain a plurality of components 135A-135C (collectively 135), sealed area 115, and a vacuum coupler 140. It should be noted that the components of the system 100 are schematically illustrated in FIG. 1, and that a variety of hardware configurations are possible in accordance with various embodiments.

In various embodiments, the plurality of components 135 may be enclosed within the inner volume 110 of the enclosure 105. The inner volume 110 of the enclosure 105 may further be sealed pneumatically around sealed area 115 of the enclosure 105. The enclosure 105 may further include a vacuum coupler 140. A vacuum pump 125 may be operatively coupled to the inner volume 110 of the enclosure 105 via the vacuum coupler 140. The oven 130 may be configured to receive the enclosure 105.

In various embodiments, the enclosure 105 may include an inner volume 110 defined by a body. The body of the enclosure 105 may be a flexible material configured to fit, form, mold, or otherwise conform to one or more components 135A-135C of the plurality of components 135 enclosed within the inner volume 110 of the enclosure 105. The plurality of components 135 may come in a variety of shapes, and include irregular features. The body may, therefore, be configured to fit, form, mold, or otherwise conform to the shapes and features of each component 135A-135C enclosed within the inner volume 110.

To facilitate contact between the body and surfaces of each of the components 135A-135C, the body of the enclosure 105 may include one or more walls formed from flexible sheets. For example, in some embodiments, the walls of the body may be formed from plastic film. The thickness of the walls (e.g., sheets) used in the body of the enclosure 105 may range between 0.5 mils (0.5 thousandths of an inch) to 3 mils. In some embodiments, the body of the enclosure 105 may be a single continuous sheet arranged to define an inner volume 110, and an opening through which to receive the materials. In other embodiments, multiple sheets may be utilized to create an inner volume enclosing the various materials. In further embodiments, multiple sheets may be utilized to create one or more inner volumes 110. For example, in some embodiments, the enclosure 105 may include a single inner volume 110 configured to enclose multiple components of the plurality of components 135, or a single inner volume 110 may be created for each respective component of the plurality of components 135.

In various embodiments, the enclosure 105 may be configured to maintain a vacuum environment within the inner volume 110. For example, as will be discussed in greater detail below, the enclosure 105 may be configured to be coupled to a vacuum pump 125. The vacuum pump 125 may be configured to evacuate fluids (e.g., gas or liquid) from the inner volume 110 of the enclosure 105, creating a vacuum environment within the inner volume 110. The vacuum environment of the inner volume 110 may, therefore, cause the body of the enclosure 105 to come into physical contact with the various surfaces of the plurality of components 135. The body of the enclosure 105 may, therefore, exert a mechanical pressure against the various surfaces of the plurality of components 135. Accordingly, the one or more sheets used to form the body of the enclosure 105 may be configured, in addition to being flexible, fitting, forming, molding, or otherwise conforming to the surfaces of the plurality of components 135, to maintain a vacuum environment in within the inner volume 110.

In various embodiments, to support the vacuum environment within the inner volume 110, the body of the enclosure 105 may be sealed. For example, in some embodiments, the body may be sealable, around sealed area 115, to create a pneumatic seal. The pneumatic seal may be created utilizing, without limitation, heat/thermal bonding, ultrasonic bonding, induction bonding, adhesives, ultrasonic bonding, zippers, ties, among other techniques. For example, in some embodiments, the sealed area 115 may be sealed with an adhesive tape, creating a pneumatic seal around the inner volume 110. In further embodiments, the sealed area 115 may be heat sealed via a heat sealer.

In some additional embodiments, the body of the enclosure 105 may further be configured to shrink when exposed to heat, further exerting pressure on the surfaces of the plurality of components 135. For example, in some embodiments, the each of the plurality of components 135 may be enclosed within a heat shrink material, such as a heat shrink tube, or wrapped within a heat shrink material. Thus, in some embodiments, the enclosure 105 may be a heat shrink material enclosing one or more of plurality of components 135.

Moreover, the body of the enclosure 105 may be configured to withstand temperatures within the oven 130 without melting, losing the vacuum environment, and otherwise losing structural integrity, as will be described in greater detail with respect to the embodiments below. Accordingly, the body of the enclosure may include, without limitation, sheets, films (e.g., plastic film, heat shrink film), wraps, or laminates. Suitable materials for the body may include, without limitation, various thermoplastic polymers such as polyethylene (PE), low density polyethylene (LDPE), polyethylene terephthalate (PET), polypropylene (PP), polyvinyl chloride (PVC), polyvinylidene chloride (PVDC), nylon, ethylene vinyl alcohol (EVOH), ethylene-vinyl acetate (EVA), polyesters, polyamides and other suitable polymer materials, or any combination of the above polymer materials.

To gain access to the inner volume 110, in some embodiments, a vacuum coupler 140 may be provided. In some embodiments, the body of the enclosure 105, or at least a wall of the body of the enclosure 105 may incorporate a vacuum coupler 140 such that the vacuum coupler 140 is integrated into wall of the enclosure 105. In other embodiments, the vacuum coupler 140 may be operatively coupled to at least one wall of the body of the enclosure 105. For example, in some embodiments, the vacuum coupler 140 may be placed within the inner volume 110 of the enclosure 105, after which it may pierce through at least one wall of the enclosure 105. Thus, the vacuum coupler 140 may be configured to prevent air or other gases from entering the inner volume, while allowing gases within the inner volume 110 to be evacuated by the vacuum pump 125. The vacuum coupler 140 may, therefore, act as a one-way valve pneumatically interfacing between the inner volume 110 and an external environment. Suitable vacuum couplers may include, without limitation, various quick-release, vacuum bag, and through-bag connectors, as known to those in the art.

The vacuum coupler 140 may then be operatively coupled to the vacuum pump 125. The vacuum pump 125 may couple to the vacuum coupler 140 via a vacuum hose. The vacuum pump 125 may, in various embodiments, be configured to evacuate gases from within inner volume 110 of the enclosure 105, via the vacuum coupler 140. In some embodiments, the inner volume 110 of the enclosure 105 may include a vacuum conduit 145 to further facilitate the evacuation of gases from the inner volume 110. For example, the conduit 145 may include a channel or pathway created within the inner volume for gases to travel away from the various features of the plurality of components 135, and to prevent gases from becoming trapped in various pockets that may form from non-uniform evacuation of the inner volume. In some embodiments, the conduit 145 may be created by a fabric, or a removable tube or hose.

In various embodiments, evacuation of the gases from within the inner volume 110 may create a vacuum pressure within the inner volume 110, that is less than the ambient atmospheric pressure. Vacuum pressures created within the inner volume 110 may include, without limitation, pressures of 18-25 inHg, at least 15 inHg, or less than 30 inHg. For example, in some embodiments, a vacuum pressure of at least 15 inHg may be created within the inner volume 110. Accordingly, the enclosure 105 may be configured to support and maintain a vacuum pressure of at least 15 inHg within the inner volume 110, and the vacuum pump 125 may be configured to create a vacuum pressure of at least 15 inHg within the inner volume 110.

Accordingly, in various embodiments, when the inner volume 110 is evacuated, the body of the enclosure 105 may form, fit, mold, or otherwise conform to the various surfaces of the plurality of components 135, including irregular surfaces found on individual components 135A-135C. Thus, the vacuum pressure may cause the body of the film to come into physical contact with the surfaces of the plurality of components, and to apply and maintain, via surface contact, a mechanical pressure against the various surfaces of the plurality of components 135. In some embodiments, the walls of the enclosure 105 may further exhibit elastic properties to facilitate surface contact with the irregular surfaces of the components 135A-135C.

In various embodiments, once a vacuum environment has been created within the inner volume 110, the enclosure 105 may be placed within oven 130 to be heated. Accordingly, the oven 130 may be configured to receive the enclosure 105, and to heat the enclosure 105, and the plurality of components 135 within the enclosure 105, to a desired temperature. For example, in some embodiments, the desired temperature may include temperatures of, without limitation, 280-400° F., at least 280° F., at least 350° F., at least 400° F., and less than 500° F. The oven 130 may further be configured to heat the enclosure 105 and plurality of components 135 within the enclosure 105, for a desired duration of time. For example, in various embodiments, the oven 130 may maintain the desired temperature for approximately 18 minutes, between 15-20 minutes, for at least 15 minutes, less than 20 minutes, or other suitable duration of time based on the type of material utilized in the body of the enclosure 105, the properties of the plurality of components 135, and the vacuum pressure within the inner volume 110.

In some further embodiments where a heat shrink material is used in the body of the enclosure 105 to enclose the plurality of components 135, the oven 130 may further activate a shrinking process of the heat shrink material. Accordingly, additional pressure may be applied, via the body of the enclosure 105, on the various surfaces of the plurality of components 135, causing tighter surface contact between the plurality of components 135 and the body of the enclosure 105, also causing increased mechanical pressure to be exerted by the body of the enclosure 105 onto the various surfaces of the plurality of components 135.

In various embodiments, through the abovementioned process of heat and pressure treatment, various properties of the plurality of components 135 may be improved. The types of materials of the plurality of components 135, which may be improved include, without limitation, metals (e.g., steel, aluminum, magnesium, various alloys, etc.), plastics, and composite materials (e.g., graphite, wood, ceramic, clay, glass, fiberglass, carbon, carbon fiber reinforced polymers, etc.). For example, performance improvements to the plurality of components 135 may include, without limitation, increased tensile strength, hardening (e.g., surface hardening, differential hardening), stress relieving, annealing, and tempering. In some embodiments, the component 135A-135C to be heat and pressure treated may be pre-treated with a powder coating, which has been found to enhance the effects of the heat and pressure treatment. For example, in some embodiments, components 135A-135C that have been powder coated, the heat and pressure treatment may cause double curing of the powder coating, enhancing the effects of the heat and pressure treatment.

In one set of embodiments, the system 100 may be utilized to implement a heat and pressure treatment process for improving a modern bow. For example, in some embodiments, the plurality of components 135 may include various parts of the bow, such as a riser 135A, upper limb 135B, and lower limb 135C. As will be described in greater detail below, with respect to FIGS. 2 & 3, the enclosure 105 may be configured to enclose the riser 135A, upper limb 135B, and lower limb 135C. The body of the enclosure 105 may be configured to conform around the various features of the riser 135A, upper limb 135B, and lower limb 135C, when a vacuum environment has been created within the inner volume 110. Thus, surface contact is made between the body of the enclosure 105 and the various surfaces of the riser 135A, upper limb 135B, and lower limb 135C, and mechanical pressure by the body onto these surfaces of the plurality of components 135. The enclosure 105 may then be placed in the oven 130 and heated to the desired temperature for the desired amount of time. For example, in some embodiments, this may be a temperature of at least 280° F. for at least 15 minutes. Once the heating process is completed, the enclosure 105 may be removed from the oven 130.

In various embodiments, the heat and pressure treatment process may increase the performance of a bow, by increasing the speed of the bow (e.g., the speed at which an arrow is fired) by 2-5 feet per second (fps). In some embodiments, heat and pressure treatment of the plurality of components 135 by the system 100 may leave the draw weight of the bow substantially unchanged. Accordingly, heat and pressure treatment via the system 100 may change various characteristics of the plurality of components 135, including, without limitation, the deformation characteristics of the components 135A-135C (e.g., ability of the components 135A-135C to return to their original form after release of a drawn bow), surface characteristics of the plurality of components 135 (e.g., friction between the riser and an arrow), and the rigidity, strength, and hardness of the plurality of components 135.

Figure 2:
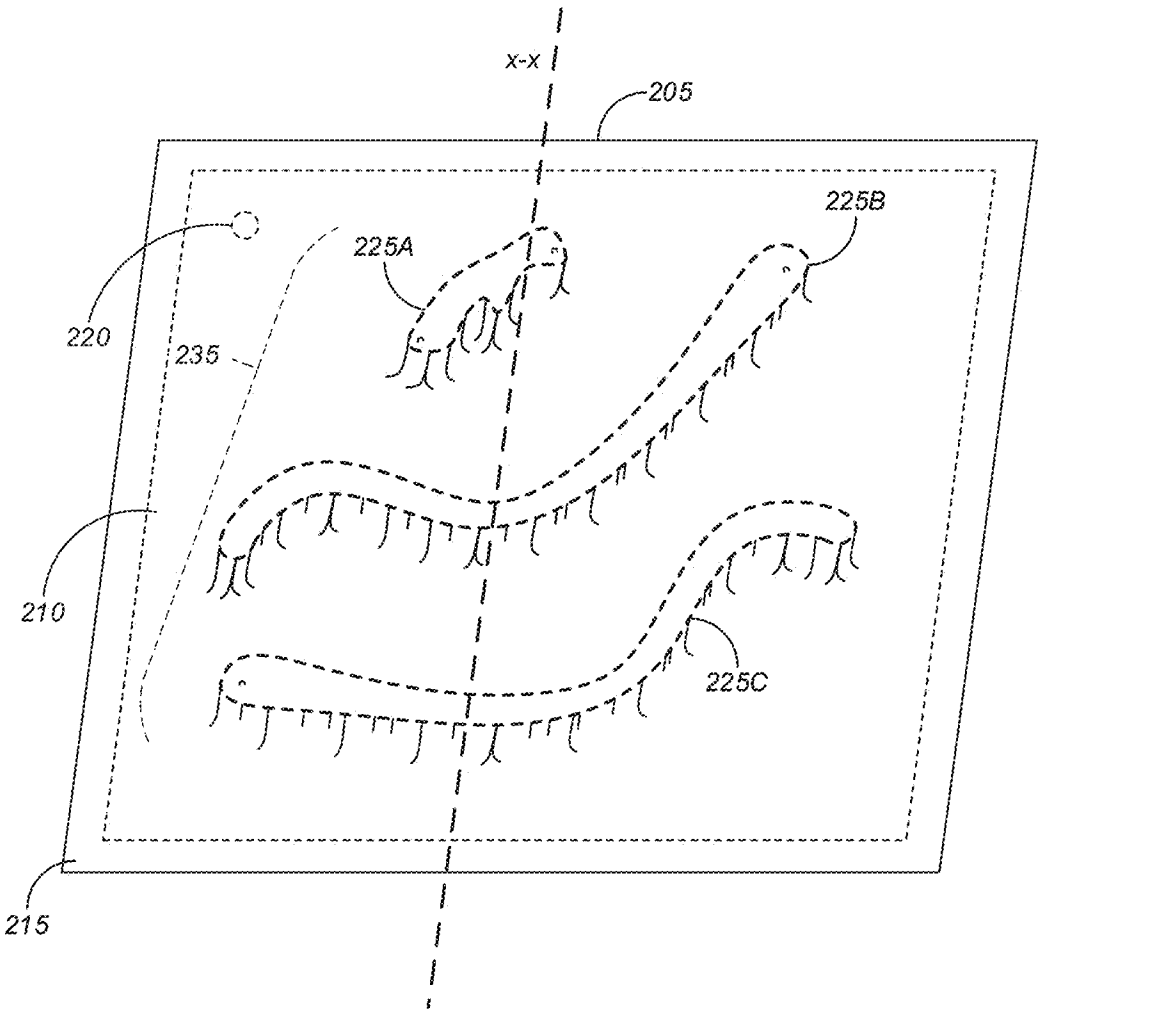
FIG. 2 is a perspective view of a vacuum enclosure holding a component for heat treatment, in accordance with various embodiments.

FIG. 2 is a perspective view 200 of an enclosure 205 holding a plurality of components 235 for heat and pressure treatment. According to various embodiments, the enclosure 205 may include an inner volume 210, and sealed area 215. The enclosure 205 may further include a vacuum coupler 220. The inner volume 210 of the enclosure 205 may enclose a plurality of components 235, including a riser 225A, upper limb 225B, and lower limb 225C.

As depicted in FIG. 2, the body of the enclosure 205 may enclose the plurality of components 235 within the inner volume 210 of the enclosure 205. In various embodiments, the enclosure 205 may be configured to allow gases within the inner volume 210 to be evacuated via the vacuum coupler 220. The inner volume 210, for example, may be in pneumatic communication with a vacuum pump via the vacuum coupler 220. As previously described with respect to FIG. 1, in some embodiments, the body of the enclosure 205 or a wall of the body of the enclosure 205 may be operatively coupled to the vacuum coupler 220. The vacuum coupler 220 may be configured to prevent air or other gases from entering the inner volume, while allowing gases within the inner volume 210 to be evacuated by a vacuum pump. The vacuum coupler 220 may include, without limitation, various quick-release, vacuum bag, and through-bag connectors, as known to those in the art.

In some embodiments, the inner volume 210 of the enclosure 205 may include a vacuum conduit to further facilitate the evacuation of gases from the inner volume 210. For example, as previously described, the conduit may include a channel or pathway created within the inner volume allowing gases to travel during the evacuation process. For example, in some embodiments, the conduit may be created by a fabric, or a removable tube or hose. In various embodiments, the body of the enclosure 205 may be configured to withstand and maintain vacuum pressures created within the inner volume 210. Vacuum pressures created within the inner volume 210 may include, without limitation, 18-25 inHg, at least 15 inHg, or less than 30 inHg. For example, the body of the enclosure 205 may be configured to support and maintain a vacuum pressure of at least 15 inHg within the inner volume 210.

Accordingly, in various embodiments, when the enclosure 205 is in an evacuated state, the body of the enclosure 205, such as a sheet or a wall, may be configured to form, fit, mold, or otherwise conform to the various surfaces of the plurality of components 235, including any irregular features of the plurality of components 235. As depicted, the walls of the enclosure 205 may conform to and contact the surfaces of each of the plurality of components 235. Thus, the vacuum pressure within the inner volume 210 may cause the walls of the enclosure 205 to collapse and conform to the surfaces of the plurality of components. Thus, the walls of the enclosure 205 may apply and maintain a mechanical pressure against the various surfaces of the plurality of components 235.

Figure 3:
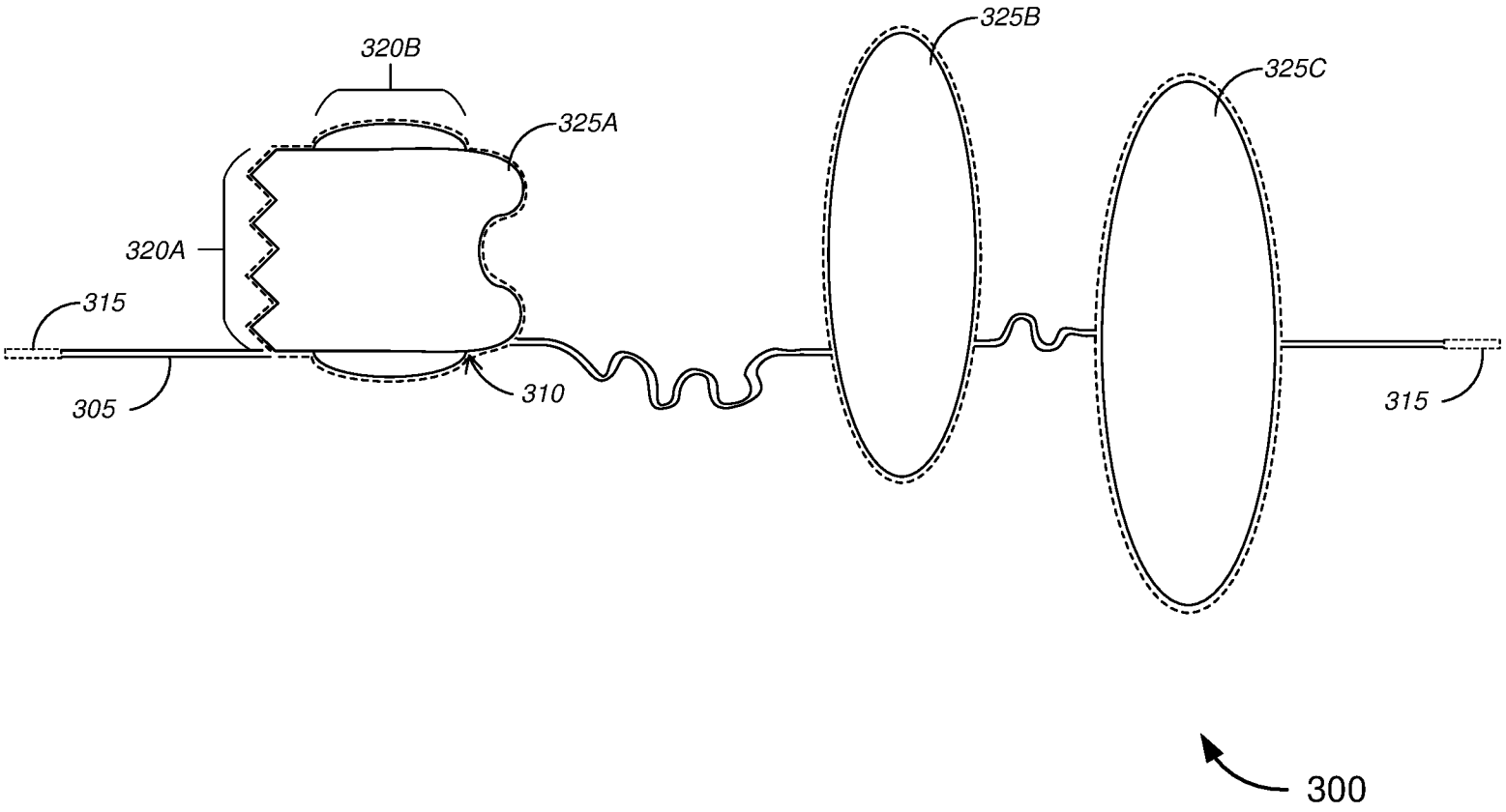
FIG. 3 is a cross sectional view of a vacuum enclosure holding a component for heat treatment, in accordance with various embodiments.

FIG. 3 is a cross sectional view 300 taken at line x-x in the perspective view 200 of FIG. 2. According to various embodiments, the sectional view 300 includes enclosure 305 with an inner volume 310 holding a plurality of components 325 for heat treatment. The sectional view 300 illustrates the enclosure 305 in an evacuated state, in which the walls of the enclosure 305 are in surface contact with each of the plurality of components 325. The sectional view 300 further includes sealed area 315, backstrap area 320A, and palm swell area 320B.

As previously described, in various embodiments, the walls of the enclosure may be configured to make surface contact with the various surfaces of a component 325A-325C. As depicted in the cross-sectional view 300, an individual component 325A-325C may include features with an irregular shape. For example, in some embodiments, one of the plurality of components 325 may be a riser 325A of a bow, which may include a backstrap area 320A, exhibiting a textured surface, and palm swell area 320B, exhibiting a raised, contoured surface. Thus, the body (e.g., sheets) of the enclosure 305 may be configured to conform to the textured surface of the backstrap area 320A including a plurality of ridges creating the texture on the backstrap area. Accordingly, each of the ridges, including the peaks and valleys of each individual ridge, of the textured surface of the backstrap area 320A, may be in surface contact with the walls of the enclosure 305. Similarly, the raised contours of the palm swell area 320B may be in surface contact with the walls of the enclosure 305. In various embodiments, by evacuating the inner volume 310 of the enclosure 305, the body of the enclosure 305 may come into surface contact around at least part of the riser 325A, including, in this case, the ridges of the backstrap area 320A and raised contours of the palm swell area 320B. It should be noted that the areas of the body (e.g., walls) in contact with the various surfaces of the plurality of components 325 are depicted in dashed lines only to distinguish from the components 325A-325C themselves. Thus, these areas of the body are illustrated in dashed lines for purposes of clarity only.

As with the riser 325A, once the inner volume 310 has been evacuated, the walls of the enclosure 305 may come into surface contact with the upper limb 325B and lower limb 325C. At line x-x, the upper limb 325B and lower limb 325C may have a substantially elliptical cross-section, to which the walls of the enclosure 305 may conform. However, the size, shape, and surface features of the upper limb 325B and lower limb 325C may change at different points along their lengths. Accordingly, the body of the enclosure 305 may be configured to conform to the surface of the upper limb 325B and lower limb 325C along the entirety of their respective lengths, through various size, shape, and feature changes.

As depicted, the body of the enclosure 305 may further include an upper sheet and a lower sheet in contact with an upper side and a lower side of the plurality of components 325, respectively. For example, a portion of the riser 325A, upper limb 325B, and lower limb 325C may be in at least partial surface contact with a lower sheet upon which the plurality of components 325 may be placed before the inner volume 310 is evacuated. Thus, the lower sheet may be configured to support at least partially the plurality of components 325. An upper sheet may be placed over the plurality of components 325 before the inner volume 310 is evacuated. Accordingly, once the inner volume 310 is evacuated, the plurality of components 325 may be in at least partial surface contact with the upper sheet. The upper and lower sheets of the enclosure 305 may together substantially cover the entirety of the surfaces of the plurality of components 325.

Figure 4:
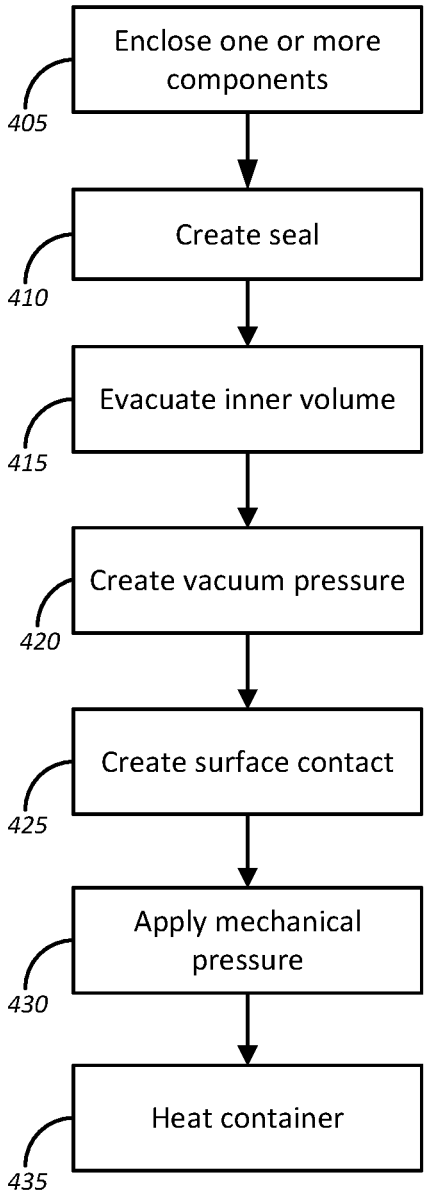
FIG. 4 is a flow diagram of a method for heat and pressure treatment, in accordance with various embodiments.

FIG. 4 is a flow diagram of a method 400 for heat and pressure treatment, according to various embodiments. The method 400 begins, at block 405, by enclosing a plurality of components within an inner volume of an enclosure. As previously described, in various embodiments, the enclosure may include an opening to receive one or more components to be heat and pressure treated within an inner volume. The inner volume may be defined by one or more walls of the body of the enclosure. For example, in some embodiments, the body of the enclosure may include one or more sheets comprising the walls of the body of the enclosure. The body of the enclosure may be a flexible, sheet-like material, configured to conform to the various shapes and features of the one or more components. In some embodiments, the inner volume may be configured to enclose multiple components. In other embodiments, a single inner volume may be configured to enclose a single respective component. In yet further embodiments, the inner volume may be configured to enclose part of a component.

The method 400 continues, at block 410, by creating a seal around at least part of a component within the inner volume. In various embodiments, the seal may be a pneumatic seal configured to sustain a vacuum pressure within the inner volume. In some embodiments, a seal may be created around the inner volume, pneumatically sealing one or more components within the inner volume. In other embodiments, multiple seals may be created around individual components, or parts of components, within an inner volume. As previously discussed, the seals may be created through various techniques, including, without limitation, heat/thermal bonding, ultrasonic bonding, induction bonding, adhesives (e.g., adhesive tape), ultrasonic bonding, zippers, and ties.

At block 415, the inner volume may be evacuated. In various embodiments, the enclosure may include a vacuum coupler configured to allow a vacuum pump to be coupled to the enclosure. Accordingly, a vacuum pump may be coupled to the vacuum coupler, allowing the vacuum pump to evacuate gases from the inner volume of the enclosure. In some embodiments, the vacuum coupler may, for example, be a one-way valve, allowing gases to be evacuated from within the inner volume, but preventing external gases from entering the inner volume.

At block 420, a vacuum pressure may be created, by the vacuum pump, within the inner volume. As gases are evacuated from the inner volume, the vacuum pump may create a vacuum pressure within the inner volume. In various embodiments, the vacuum pump may be configured to create a desired vacuum pressure, for example, and without limitation, in the range of 18-25 inHg, at least 15 inHg, or less than 30 inHg. Correspondingly, the inner volume of the enclosure and the pneumatic seal around the components may be configured to sustain the vacuum pressures. For example, in some embodiments, a vacuum pressure of at least 15 inHg may be created within the inner volume. Accordingly, the inner volume of the enclosure may be configured to support and maintain a vacuum pressure of at least 15 inHg.

At block 425, surface contact is created between the body of the enclosure and the various surfaces of the one or more components to be heat and pressure treated. As previously described, in various embodiments, the body of the enclosure may comprise one or more walls formed from one or more flexible sheets. The thickness of the walls (e.g., sheets) used in the body of the enclosure 105 may range between 0.5 mils to 3 mils. Thus, the body of the enclosure, including the walls of the inner volume, may be a flexible material configured to fit, form, mold, or otherwise conform the one or more components enclosed within the inner volume. The vacuum environment of the inner volume may, therefore, cause the body of the enclosure to make surface contact with the various surfaces of the one or more components. For example, in some embodiments, the one or more components may exhibit features or shapes with irregular surfaces. Accordingly, the flexible sheets may, under vacuum pressure, conform to the features of the one or more features to make surface contact with the irregular surfaces. In various embodiments, the walls of the enclosure may further exhibit elasticity to facilitate surface contact.

Suitable materials for the body of the enclosure may include, without limitation, sheets, films (e.g., heat shrink film), wraps, or laminates. Suitable materials for the body may include, without limitation, various thermoplastic polymers such as polyethylene (PE), low density polyethylene (LDPE), polyethylene terephthalate (PET), polypropylene (PP), polyvinyl chloride (PVC), polyvinylidene chloride (PVDC), nylon, ethylene vinyl alcohol (EVOH), ethylene-vinyl acetate (EVA), polyesters, polyamides and other suitable polymer materials, or any combination of the above polymer materials.

At block 430, mechanical pressure is applied to the one or more components via the body of the enclosure. As surface contact is made between the body of the enclosure and the various surfaces of the one or more components, in various embodiments, under the vacuum pressure created by the vacuum pump, the body of enclosure may exert a mechanical pressure against the various surfaces of the plurality of components with which the body is in surface contact. In some embodiments, the elasticity of the body of the enclosure may also exert additional mechanical pressure on the one or more components. In some further embodiments where a heat shrink material is utilized, additional mechanical pressure may be exerted via the shrinking process, for example, when the enclosure is heated in an oven. By exerting a mechanical pressure via the body of the enclosure, a pressurized environment may be created locally around the component to be pressure and heat treated.

At block 435, the enclosure may be heated. As previously described, in various embodiments, once a vacuum environment has been created within the inner volume, the enclosure may be placed within an oven to be heated. Accordingly, the oven may be configured to receive the enclosure, and to heat the enclosure, including the one or more components, to a desired temperature. For example, in some embodiments, the desired temperature includes temperatures of, without limitation, 280-400° F., at least 280° F., at least 350° F., at least 400° F., and less than 500° F. The amount of time that the enclosure is heated may also be controlled. For example, in various embodiments, the desired heating time may include, without limitation, approximately 18 minutes, between 15-20 minutes, at least 15 minutes, at least 20 minutes, less than 25 minutes, or other suitable durations of time based on the type of material utilized in the body of the enclosure, the properties of the plurality of components, and the vacuum pressure within the inner volume. In some further embodiments where a heat shrink material is used in the body of the enclosure to enclose the plurality of components, the heating process may further activate a shrinking process of the heat shrink material. Accordingly, additional pressure may be applied, via the body of the enclosure, on the various surfaces of the plurality of components.

While certain features and aspects have been described with respect to exemplary embodiments, one skilled in the art will recognize that numerous modifications are possible. For example, the methods and processes described herein may be implemented using different combinations of hardware components. Further, while various methods and processes described herein may be described with respect to structural and/or functional components for ease of description, methods provided by various embodiments are not limited to any specific structural and/or functional architecture, but instead can be implemented utilizing any suitable configuration or arrangement of parts. Similarly, while certain functionality is ascribed to certain system components, unless the context dictates otherwise, this functionality can be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Moreover, the procedures described with respect to one method or process may be incorporated within other described methods or processes; likewise, system components described according to a particular structural architecture and/or with respect to one system may be organized in alternative structural architectures and/or incorporated within other described systems. Hence, while various embodiments are described with—or without—certain features for ease of description and to illustrate exemplary aspects of those embodiments, the various components and/or features described herein with respect to a particular embodiment can be substituted, added and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A system comprising:

a vacuum pump;

an enclosure comprising a body defining an inner volume, wherein the enclosure is configured to enclose at least part of a component within the inner volume, pneumatically seal at least part of the component within the inner volume, and sustain a vacuum pressure that is less than an ambient atmospheric pressure around the at least part of the component within the inner volume;

an oven configured to receive and heat the enclosure;

wherein the vacuum pump is configured to be operatively coupled to the enclosure, evacuate gases within the inner volume, and create the vacuum pressure within the inner volume of the enclosure; and wherein, under the vacuum pressure, the body is configured to make surface contact with a surface of the at least part of the component, and configured to pressure treat the at least part of the component via application of a mechanical pressure against the surface of the at least part of the component, and wherein at least one of:

the vacuum pump is configured to create a vacuum pressure of at least 15 inches of mercury (inHg) within the inner volume; and the oven is configured to heat the enclosure to a temperature in the range of 280°-400° F., wherein the body is further configured to maintain the mechanical pressure against the surface of the at least part of the component at the at least one of the vacuum pressure of at least 15 inches of mercury within the inner volume and temperature in the range of 280°-400° F.

2. The system of claim 1, wherein the enclosure further comprises a vacuum coupler configured to allow the vacuum pump to be in pneumatic communication with the inner volume of the enclosure.

3. The system of claim 1, wherein the enclosure further comprises a conduit configured to allow gases to travel within the inner volume during evacuation by the vacuum pump.

4. The system of claim 1, wherein the at least part of the component includes an irregular surface, wherein the body is configured to conform to the irregular surface of the at least part of the component such that surface contact is maintained between the body of the enclosure and the irregular surface.

5. The system of claim 1, wherein the body includes one or more plastic film walls.

6. The system of claim 5, wherein the plastic film walls include at least one of a polyethylene (PE), low density polyethylene (LDPE), polyethylene terephthalate (PET), polypropylene (PP), polyvinyl chloride (PVC), polyvinylidene chloride (PVDC), nylon, ethylene vinyl alcohol (EVOH), ethylene-vinyl acetate (EVA), polyester, or polyamide material.

7. The system of claim 1, wherein the enclosure is configured to be sealed via an adhesive tape.

8. The system of claim 1, wherein the component is one of a riser or limb of a bow, wherein the enclosure is configured to apply the mechanical pressure against the surface of at least part of the riser or limb.

9. An apparatus comprising:

an enclosure comprising a body defining an inner volume, wherein the enclosure is configured to enclose at least part of a component within the inner volume, pneumatically seal at least part of the component within the inner volume, and sustain a vacuum pressure that is less than an ambient atmospheric pressure around the at least part of the component within the inner volume, wherein the enclosure is further configured to allow gases to be evacuated from within the inner volume, wherein, under the vacuum pressure, the body is configured to make surface contact with a surface of the at least part of the component, and to pressure treat the at least part of the component via application of a mechanical pressure against the surface of the at least part of the component, and wherein the enclosure is further configured to be heated, via an oven, to a first temperature and substantially maintain structural properties at the first temperature, wherein the enclosure is configured to be at least one of:

heated to and maintain structural properties in a temperature range of 280°-400° F., wherein the first temperature is in the temperature range of 280°-400° F.; and sustain the vacuum pressure within the inner volume of at least 15 inHg, wherein the enclosure is configured to maintain the mechanical pressure against the surface of the at least part of the component at the at least one of the vacuum pressure of at least 15 inches of mercury within the inner volume and temperature in the range of 280°-400° F.

10. The apparatus of claim 9, wherein the enclosure further comprises a conduit configured to allow gases to travel within the inner volume during evacuation.

11. The apparatus of claim 9, wherein the at least part of the component includes an irregular surface, wherein the body is configured to conform to the irregular surface of the at least part of the component such that surface contact is maintained between the body of the enclosure and the irregular surface.

12. The apparatus of claim 9, wherein the body of the enclosure includes one or more plastic film walls.

13. The apparatus of claim 12, wherein the one or more plastic film walls include at least one of a polyethylene (PE), low density polyethylene (LDPE), polyethylene terephthalate (PET), polypropylene (PP), polyvinyl chloride (PVC), polyvinylidene chloride (PVDC), nylon, ethylene vinyl alcohol (EVOH), ethylene-vinyl acetate (EVA), polyester, or polyamide material.

14. The apparatus of claim 9 further comprising one or more components enclosed within the inner volume of the enclosure, wherein the one or more components includes at least one of a riser or limb of a bow.

15. A method comprising:

receiving, via an enclosure, one or more components;

sealing pneumatically, within an inner volume of the enclosure, the one or more components;

evacuating, via a vacuum pump, gases from within the inner volume of the enclosure;

creating, via the vacuum pump, a vacuum pressure within the inner volume of the enclosure;

creating surface contact between a body of the enclosure and a surface of the one or more components;

maintaining, via the enclosure, the vacuum pressure of at least 15 inHg within the inner volume of the enclosure;

heating, via the oven, the enclosure to the first temperature in the range of 280°-400° F.;

pressure treating, via the body of the enclosure, the one or more components, wherein pressure treating further comprises applying, via the body of the enclosure, a mechanical pressure on the surface of the one or more components, wherein pressure treating the one or more components further comprises maintaining, via the enclosure, the mechanical pressure against the surface of the one or more components at the vacuum pressure of at least 15 inches of mercury within the inner volume and temperature in the range of 280°-400° F.; and heating, via an oven, the enclosure to a first temperature.

* * * * *